US005381971A

United States Patent [19]

Rehmer

[11] Patent Number: 5,381,971

[45] Date of Patent: Jan. 17, 1995

[54] GRINDING APPARATUS

[75] Inventor: Carl A. Rehmer, Red Bud, Ill.

[73] Assignee: Williams Patent Crusher and Pulverizer Company, St. Louis, Mo.

[21] Appl. No.: 88,684

[22] Filed: Jul. 9, 1993

[51] Int. Cl.[6] ..... B02C 13/08; B02C 13/288

[52] U.S. Cl. ..... 241/55; 241/56; 241/88.4; 241/194

[58] Field of Search ..... 241/55, 73, 88.4, 194, 241/56

[56] References Cited

U.S. PATENT DOCUMENTS

| | | | |
|---|---|---|---|
| 730,503 | 6/1903 | Williams | 241/55 X |
| 1,306,316 | 4/1919 | Plaisted | 241/194 |
| 1,751,009 | 3/1930 | Liggett | 241/73 |
| 1,902,721 | 3/1933 | Reynolds | 241/55 |
| 2,594,583 | 4/1952 | Richardson | 241/55 |
| 2,785,865 | 3/1957 | Berling | 241/55 |
| 3,430,873 | 3/1969 | Wahl et al. | 241/55 |
| 3,480,214 | 11/1969 | Wageneder | 241/185 |
| 3,482,788 | 12/1969 | Newell | 241/194 X |
| 3,549,093 | 12/1970 | Pallmann | 241/55 X |
| 3,610,543 | 10/1971 | Jensen | 241/73 |
| 3,643,879 | 2/1972 | Palyi | 241/55 |
| 3,813,045 | 5/1974 | Greiffenstern | 241/88.4 |
| 4,009,836 | 3/1977 | Strom et al. | 241/73 |
| 4,175,710 | 11/1979 | Robertson | 241/55 |
| 4,202,503 | 5/1980 | Parkinson et al. | 241/194 |
| 4,637,557 | 1/1987 | Vitunac | 241/73 |
| 4,706,898 | 11/1987 | Schonfeld et al. | 241/73 |
| 4,706,899 | 11/1987 | Parker et al. | 241/73 |
| 5,018,674 | 5/1991 | Williams | 241/88.4 |

FOREIGN PATENT DOCUMENTS

| | | | |
|---|---|---|---|
| 35158 | 1/1965 | Germany | 241/55 |
| 70649 | 8/1952 | Netherlands | 241/56 |

*Primary Examiner*—Mark Rosenbaum
*Assistant Examiner*—Frances Han
*Attorney, Agent, or Firm*—Polster, Lieder, Woodruff & Lucchesi

[57] ABSTRACT

Apparatus for reducing material in which a rotor is formed with a plurality of material impact hammers and fan elements mounted on the rotor for simultaneously reduced material upon impact and moving the reduced material through the rotor, and a housing encloses the rotor between a material inlet and a reduced material outlet with the fan elements preventing reduced material bypassing the outlet to return to the inlet.

1 Claim, 1 Drawing Sheet

GRINDING APPARATUS

BACKGROUND OF THE INVENTION

This invention is directed to an improvement in grinding apparatus which is combined with a fan to assure flow of material from the inlet to the outlet of the housing in which material grinding apparatus is mounted.

Crushing and grinding machines of the character disclosed in U.S. Pat. No. 4,706,898 of Nov. 17, 1987 are typical of apparatus that requires excessive power consumption due to the high resistance offered by the outlet grate which presents surfaces which block the free flow of material after being ground or processed.

Typical in the art is material reducing apparatus having pivoted or free swinging hammers on a driven rotor mounted in a housing having grate structure that restricts the outflow of reduced material. Apparatus of this character can be found in such U.S. Pat. Nos. as 1,301,316 of Apr. 22, 1919 or 1,751,009 of Mar. 18, 1930, or 3,610,543 of Oct. 5, 1971 or 4,009,836 of Mar. 1, 1977. In such apparatus the pivoted hammers are quite capable of damaging the drive shaft on which they are mounted by the result of hammer rebound when striking a large heavy article.

Apparatus of the foregoing character is found to be difficult to reduce light weight or fluffy material which is due in the most part, to the resistance of the grate surface which causes such material to bypass the grate and return to the material receiving side of the rotor.

The foregoing objections in the prior art are substantially overcome by a unique combination of pivoting hammers that are free to rotate, or even rebound, but do not strike the shaft on which they are mounted, a grate structure in the outlet that greatly reduces resistance to the outflow of reduced materials, and fan means moving with the hammers to propel the reduced material through the outlet, thereby avoiding the need for an external fan.

Figure 1:
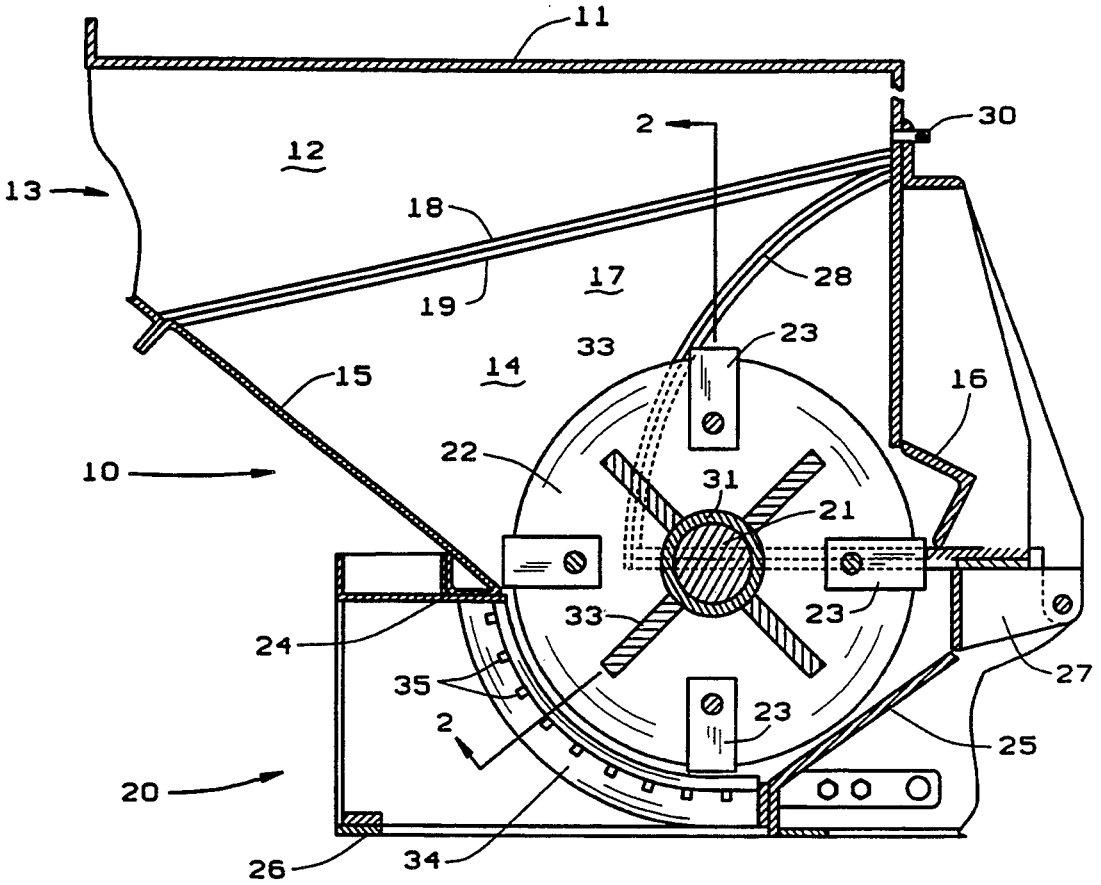
Figure 2:
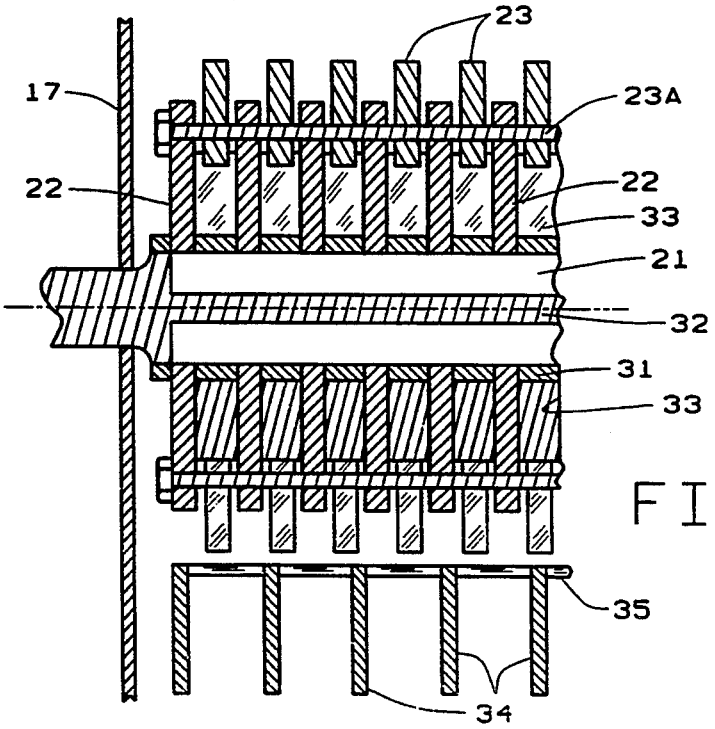

Further objects of this invention will be set forth in greater detail in the accompanying drawing wherein:

FIG. 1 is a vertical sectional view of the grinding apparatus embodying the present invention, and FIG. 2 is a fragmentary sectional view to illustrate the characteristics of the hammer and fan rotor, as seen along line 2—2 in FIG. 1.

DETAIL DESCRIPTION OF THE EMBODIMENT.

The grinding apparatus 10 requires a suitable housing 11 formed with an enclosure area 12 having an inlet opening 13 through which material to be reduced is moved. The housing 11 has a bottom chamber 14 composed of a slanted material feed wall 15 and an opposed breaker wall 16 which, together with side walls shown at 17, are secured to the bottom flange 18 by a matching flange 19. Those flanges 18 and 19 can be connected by bolts to afford a rigid base structure 20. The base 20 supports suitable bearings (not shown) for a shaft 21 which supports a series of axially spaced discs 22 which define circumferential slots to receive the hammers 23 of which there are four spaced around the shaft 21 and pivotally suspended by a shaft 23A extending through the slots between adjacent pairs of discs 22.

The base 20 has an upper flange 24 on which the bottom chamber 14 rests so that the breaker wall 16 can be positioned close to the discs 22 to bring the hammers 23 into close proximity to the breaker wall 16 for effective reduction of the material. As is seen in the drawing the base 20 has a closure wall 25 which is an effective continuation of the breaker wall 16.

It is seen in the drawing that the base 20 has the breaker wall 25 which closes the rear of the chamber 14 and a front structure 26 so that the two parts can be dismantled for the purpose of inserting and removing the rotor shaft 21 with its assembled discs 22 and hammers 23. The breaker wall 16 is also movable about a hinge member 27 which permits the wall 16 to separate along the parting flange 28 when the retainer means 30 is released.

The assembly of the discs 22 on the shaft 21 is obtained by a shaft sleeve 31 that is keyed to the shaft 21 by a longitudinal key 32. While the respective hammers are pivotally connected on a pivot rod 23A between adjacent pairs of discs 22, the fan device comprises flat fan blades 33 welded to adjacent discs 22 so as to occupy a position at about 45° to the adjacent hammers 23.

The normal direction of rotation of the shaft 21 is clockwise, or in the direction to throw the incoming material against the breaker walls 16 and 25. Thus, the fan blades 33 will move in the same direction so that air, gases and vapors which are in the chamber 14 with incoming material will be drawn into the rotor and be forced to pass through the front structure 26 of the base 20. In moving the flow of material and air through the front structure 26 it is important to avoid placing any obstruction in that flow path. If there is obstruction the gases, air, and some light weight material will be carried around by the rotor discs 22 and re-enter the chamber 14 which increases the power demand. To avoid this problem, grate means is inserted in the base in the form of grate bars that are directed to be perpendicular to the axis of the shaft 21. The grate bars are arcuately shaped and set in spaced apart relation and having a length to span the distance from the flange 24 to the junction of the meeting between the wall 25 and the wall 26 of frame 20. These bars 34 are secured in spaced positions by narrow bars 35 that have a small cross sectional dimension, and are also secured at the respective ends. The leading edges of the grate bars 34 are curved to present narrow edges to the tip circle of the hammers 23 so there is prevented any development of diversion or a back-flow in the light weight material.

The object of the arrangement of narrow curved grate bars 34 over the outlet opening from the rotor is to prevent a flow of light weight material bypassing the outlet and returning to the bottom chamber 14 where it mingles with the incoming material moving into the rotary orbit of the hammers 23 from the space 12.

In view of the foregoing description it can be appreciated that the grinding apparatus has the unique feature of preventing a back flow to the inlet side of the material reducing hammers so that there is a considerable reduction in the electrical power demand driving the shaft 21, and there is reduced or eliminated any need for a fan external to the apparatus for insuring the pass through flow through character which is desirable. Furthermore, the pivoted hammers 23 are so designed as to have effective radial lengths thereof from the point of pivoting so that when hammer rebound occurs there will be no possibility of any hammer pounding on the shaft sleeve 31 or engaging on any fan blade 33. It should now be apparent that the fan effect of the blades 33 adds to the effect of the hammer rotors to drive the material through the spaces between the grate bars 34 as these bars impose a very low or negligible resistance, particularly with respect to light weight material.

What is claimed is:

1. Material reducing apparatus comprising:

a) an elongated rotary shaft having a horizontal axis of rotation;

b) discs carried on said shaft and arranged in spaced relation axially along said shaft to define slot spaces surrounding said rotary shaft;

c) material impact hammers pivotally mounted between said discs to occupy said slot spaces, said impact hammers being free to rotate relative to said rotary shaft and within said slot spaces;

d) fan elements placed in said slot spaces between said discs to occupy positions in said slot spaces between said impact hammers out of the path of rotation of said impact hammers;

e) housing means enclosing said rotary shaft, said discs and impact hammers and fan elements, said housing having a material inlet opening and a reduced material outlet, whereby said fan elements in rotation with said shaft simultaneously entrain material from said inlet and impel reduced material in a direction radially of said rotary shaft for flow directly through said outlet; and f) grate bars mounted in said reduced material outlet and being formed with leading edges offering minimum obstruction in the path of material impelled through said outlet.

* * * * *